US007244218B1

(12) United States Patent
Lin et al.

(10) Patent No.: US 7,244,218 B1
(45) **Date of Patent: *Jul. 17, 2007**

(54) ANGLE ADJUSTABLE PEDALS FOR ELLIPTICAL EXERCISERS

(75) Inventors: Man-Mei Lin, TaLi (TW); Kuang-Shiung Kao, TaLi (TW); Joe Halfen, Andover, MN (US); Timothy Porth, Andover, MN (US)

(73) Assignee: Octane Fitness, LLC, Brooklyn Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/325,033

(22) Filed: Jan. 4, 2006

Related U.S. Application Data

(63) Continuation of application No. 10/611,971, filed on Jul. 3, 2003, now Pat. No. 7,037,242.

(51) Int. Cl.
*A63B 22/06* (2006.01)
*A63B 69/16* (2006.01)

(52) U.S. Cl. ..... 482/52; 482/57; 482/908

(58) Field of Classification Search ..... 482/51, 482/52, 57, 70, 79–80, 908
See application file for complete search history.

(56) References Cited

U.S. PATENT DOCUMENTS

| | | | | |
|---|---|---|---|---|
| 4,630,839 | A * | 12/1986 | Seol | 280/255 |
| 5,235,867 | A * | 8/1993 | Wortmann et al. | 74/501.5 R |
| 5,683,331 | A * | 11/1997 | Dalebout | 482/52 |
| 5,690,589 | A | 11/1997 | Rodgers, Jr. | |
| 6,170,355 | B1 | 1/2001 | Fay, III | |
| 6,500,096 | B1 | 12/2002 | Farney | |
| 6,719,665 | B1 | 4/2004 | Lai | |

* cited by examiner

*Primary Examiner*—Stephen R. Crow
(74) *Attorney, Agent, or Firm*—Sherrill Law Offices, PLLC

(57) ABSTRACT

An angle adjustable pedal assembly for elliptical exercisers includes a pedal frame and a pedal which is pivotably connected to two sides on an end of the pedal frame. Each side wall has a hole with three notches defined in an inside of the hole and the pedal has two connection plates each of which has a reset slot and a set slot which communicates with the reset slot. A pin extends through one of the reset slot and the set slot, and is engaged with one of the three notches in the side walls so that the pedal can be set at different angle relative to the pedal frame by engaging with one of the three notches in the side walls.

8 Claims, 11 Drawing Sheets

ANGLE ADJUSTABLE PEDALS FOR ELLIPTICAL EXERCISERS

This application is a continuation of patent application Ser. No. 10/611,971 filed on Jul. 3, 2003, now U.S. Pat. No. 7,037,242.

FIELD OF THE INVENTION

The present invention relates to an elliptical exerciser having two pedals which are angle adjustable so as to meet different requirements of the users.

BACKGROUND OF THE INVENTION

A conventional elliptical exerciser 10 is disclosed in FIG. 1 and generally includes a frame 11 and a wheel 12 is connected thereto, a crank 13 is connected to the wheel so that a user may hold the handle 15 and step on the pedals 161 on the pedal frame 16 to operate the exerciser. A connection bar 14 is pivotably connected to an end of the crank 13 and the other end of the connection bar 14 is connected to the handles 15. One end of the connection bar 14 is pivotably connected to an end of the pedal frames 16 and the other end of the connection bar 14 is pivotably connected to a link which is pivotably connected to the frame 11. The user holds and swings the handles 15 while the feet alternatively operate the pedals 161 in an elliptical trace. The pedal frames 16 each have a roller 162 which is rolls on a rail 17 on the ground. The rails 17 can be raised at an angle relative to the ground so as to adjust the exercising levels to meet different requirements of the users. Nevertheless, as disclosed in FIG. 2, the pedals 161 and the pedal frames 16 are made as a one-piece so that the pedals cannot be adjusted according to the change of the rails 17.

The present invention intends to provide angle adjustable pedals for elliptical exercisers wherein the pedals can be adjusted relative to the pedal frames.

SUMMARY OF THE INVENTION

In accordance with one aspect of the present invention, there is provided an pedal assembly for an elliptical exerciser and the pedal assembly includes a pedal frame having a first end pivotably connected to a connection bars connected to the crank on the wheel, and a second end of the pedal frame has two side walls. An end plate is connected between the two side walls and each side wall has a hole and three notches are defined in an inside of the hole. A roller is connected to the pedal frame and movably engaged to the rail.

A pedal has two connection plates which are pivotably connected to the two side walls of the pedal frame. Each connection plate has a set slot and a reset slot defined therethrough. The set slot and the reset slot communicate with each other and a angle is defined between two axes of the set slot and the reset slot. A pin extends through one of the set slot and the reset slot and the hole. A bolt extends through the end plate and is fixedly connected to a mediate portion of the pin. A spring is mounted to the bolt and biased between the pin and the end plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
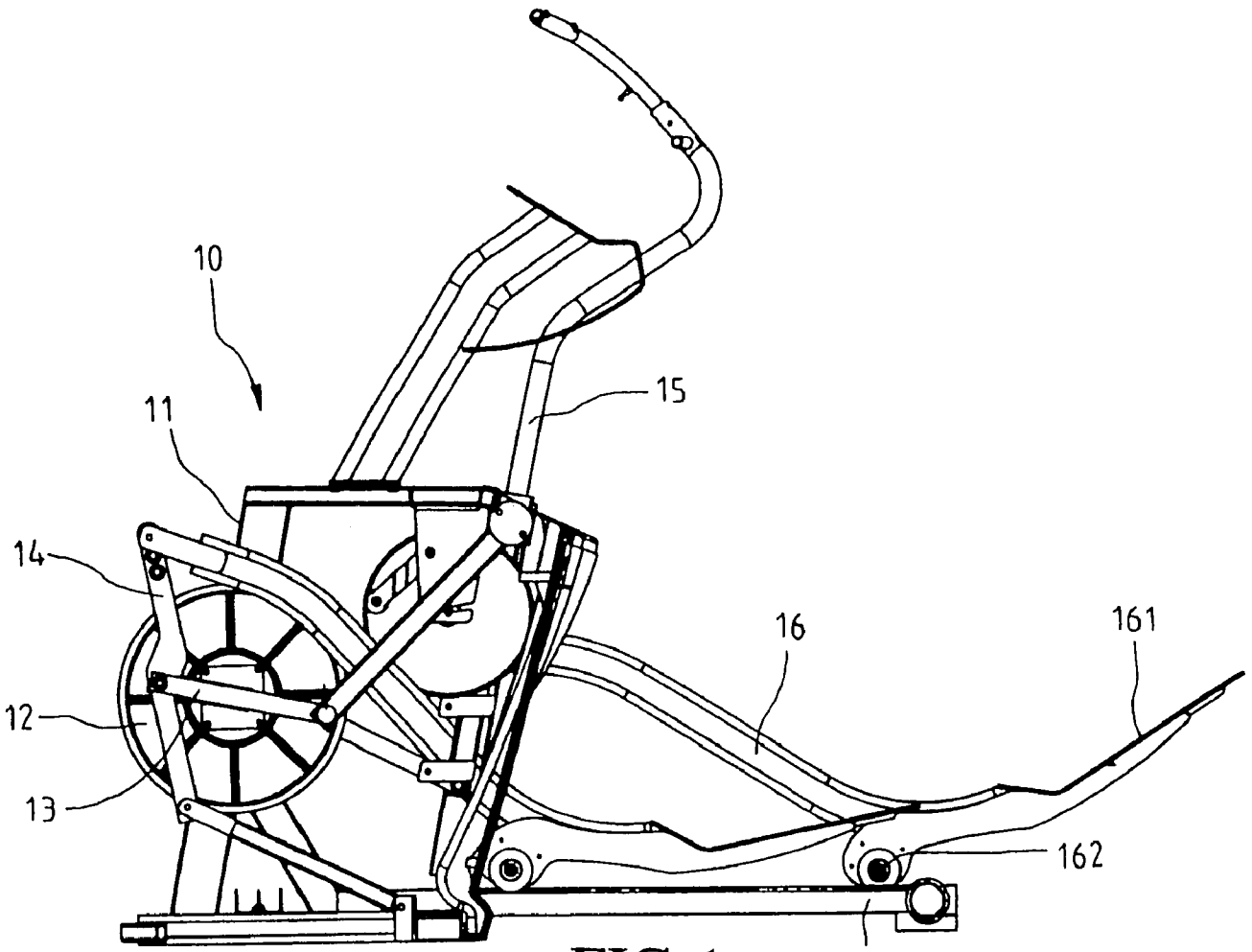
FIG. 1 PRIOR ART
FIG. 1 shows a conventional elliptical exerciser.
Figure 2:
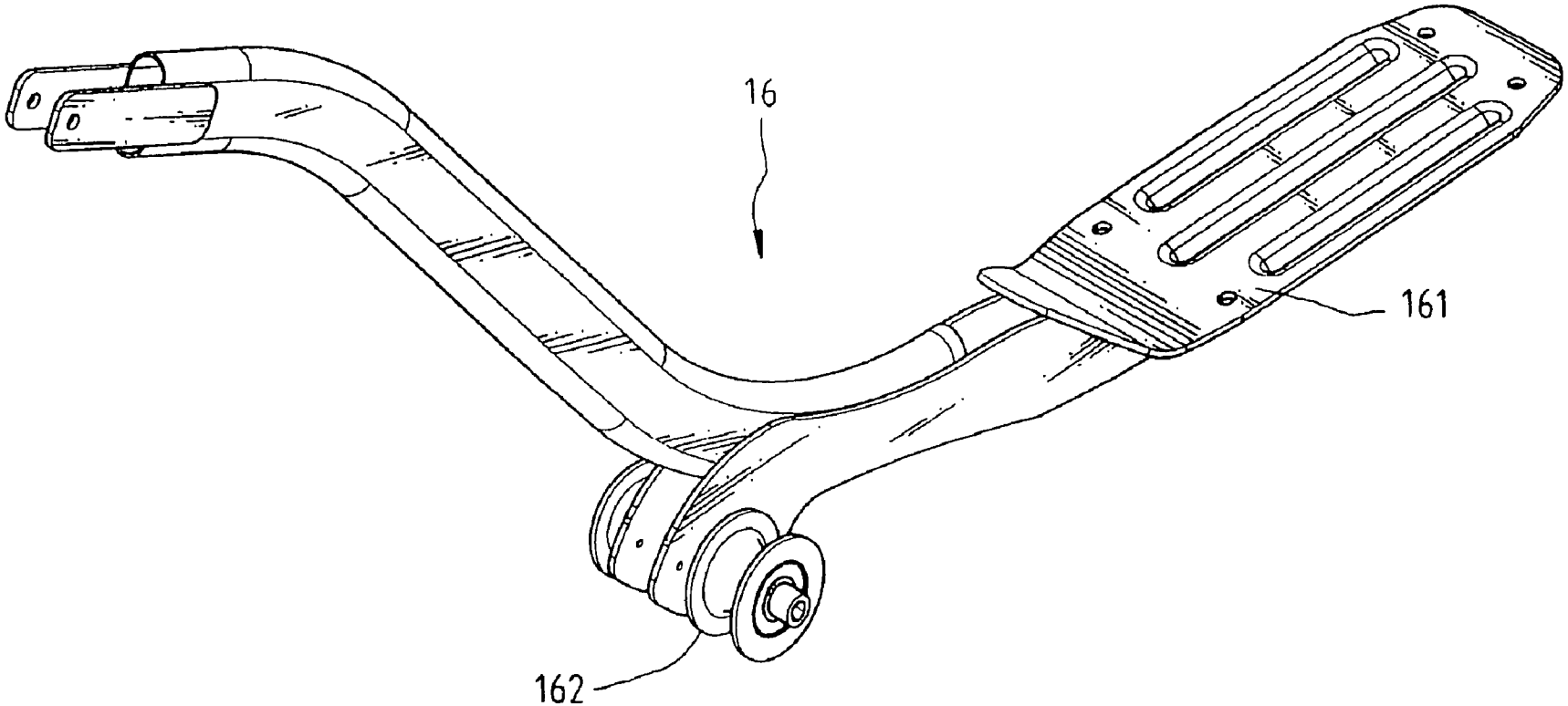
FIG.2 PRIOR ART
FIG. 2 is a perspective view of the pedal of the conventional elliptical exerciser.
Figure 3:
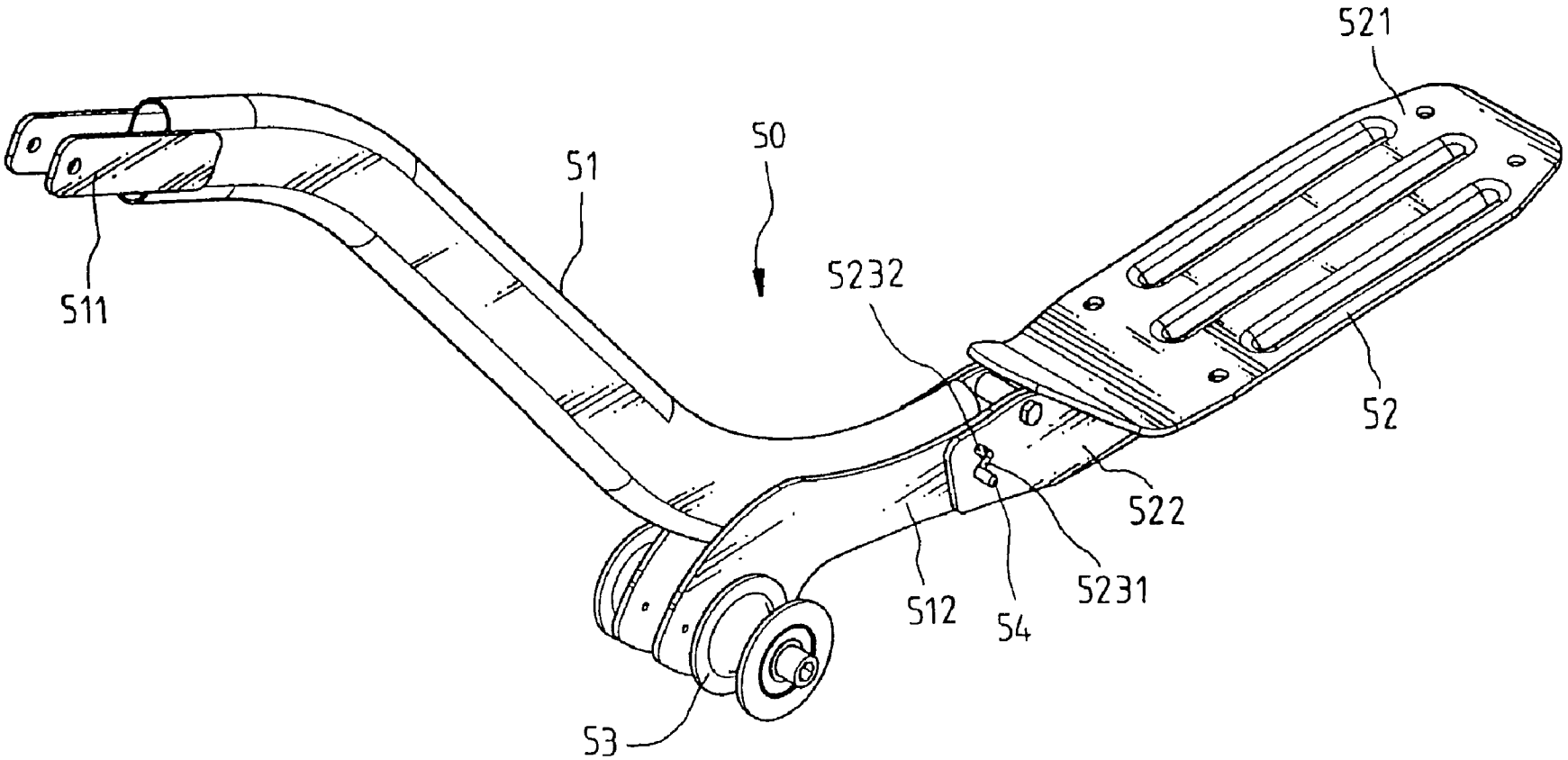
FIG. 3 is a perspective view of the pedal assembly of the present invention.
Figure 4:
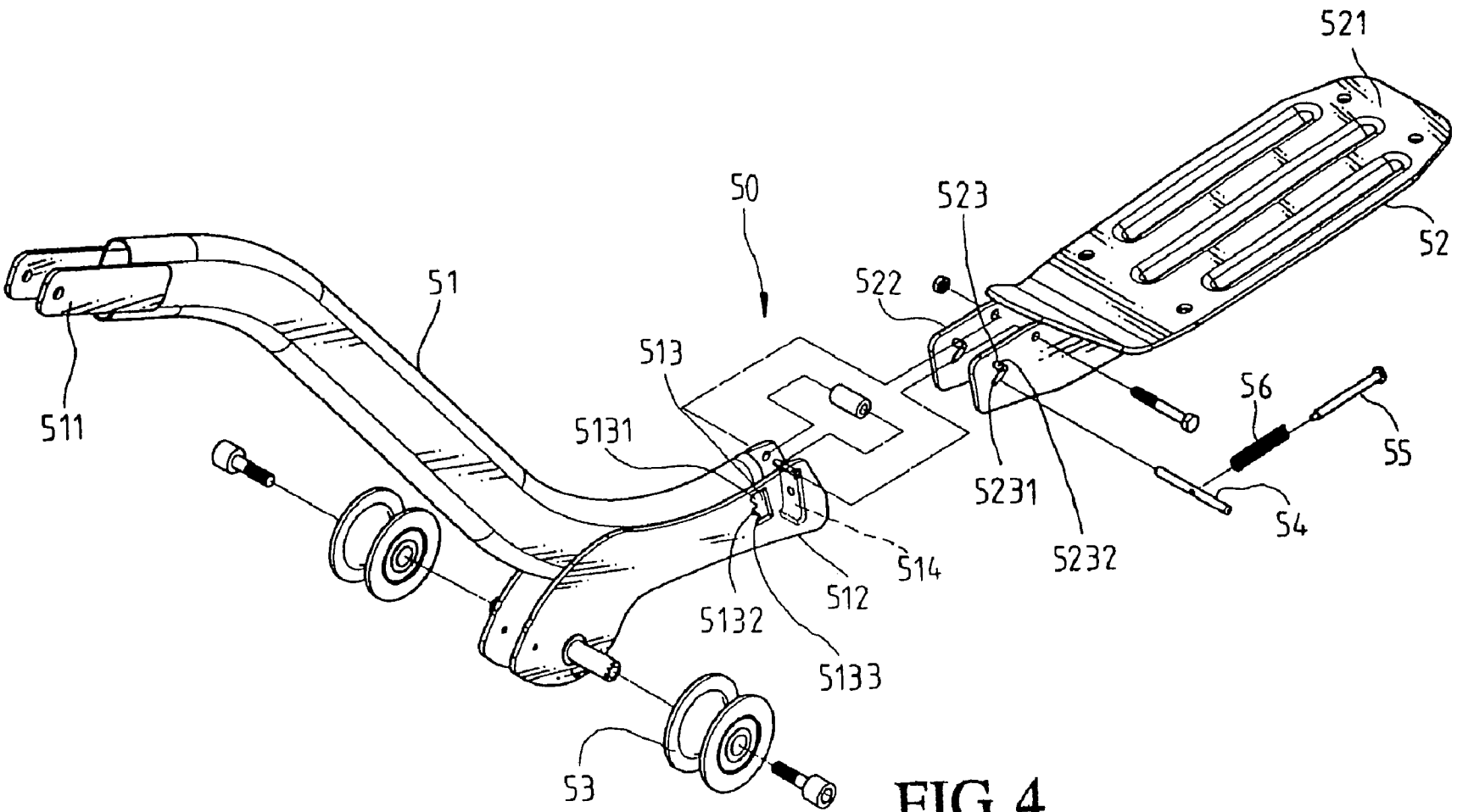
FIG. 4 is an exploded view to show the pedal assembly of the present invention.

Referring to FIGS. 3 to 6, the elliptical exerciser of the present invention comprises a frame 20 having a wheel 30 connected thereto and a crank 310 (FIG. 5) is connected to the wheel 30. Each one of two ends of the crank 310 has an extension link 31 and the extension links 31 are located on two sides of the wheel 30. A mediate portion of a connection bar 32 is pivotably connected to an end of each of the extension links 31 and the other end of each of the extension link 31 is connected to an end of a handle 40. An end of each of the connection bars 32 is pivotably connected to a link 200 (FIG. 5) which is pivotably connected to the frame 20. Two rails 60 each have an end pivotably connected to the frame 20 and the other end of each of the rails 60 connected to a lifting device 70 which is a hydraulic cylinder so that the rails 60 can be raised by operating the hydraulic cylinders.

Two pedal assemblies 50 each comprise a pedal frame 51 having two lugs 511 on a first end thereof which is pivotably connected to the other end of each of the connection bars 32. A second end of the pedal frame 51 has two side walls 512 and an end plate 514 is connected between the two side walls 512. Each side wall 512 has a hole 513 and three notches 5131, 5132, 5133 are defined in an inside of the hole 513. Two rollers 53 are connected to each pedal frame 51 and movably engaged to the rail 60.

A pedal 52 has two connection plates 522 which are pivotably connected to the two side walls 512. Each connection plate 522 has hole 523 which is composed of a set slot 5231 and a reset slot 5232. The set slot 5231 and the reset slot 5232 communicate with each other and a angle is defined between two axes of the set slot 5231 and the reset slot 5232.

A pin 54 extends through one of the set slot 5231 and the reset slot 5232 and the hole 513. A bolt 55 extends through the end plate 514 and is fixedly connected to a mediate portion of the pin 54. A spring 56 is mounted to the bolt 55 and biased between the pin 54 and the end plate 514.

Figure 5:
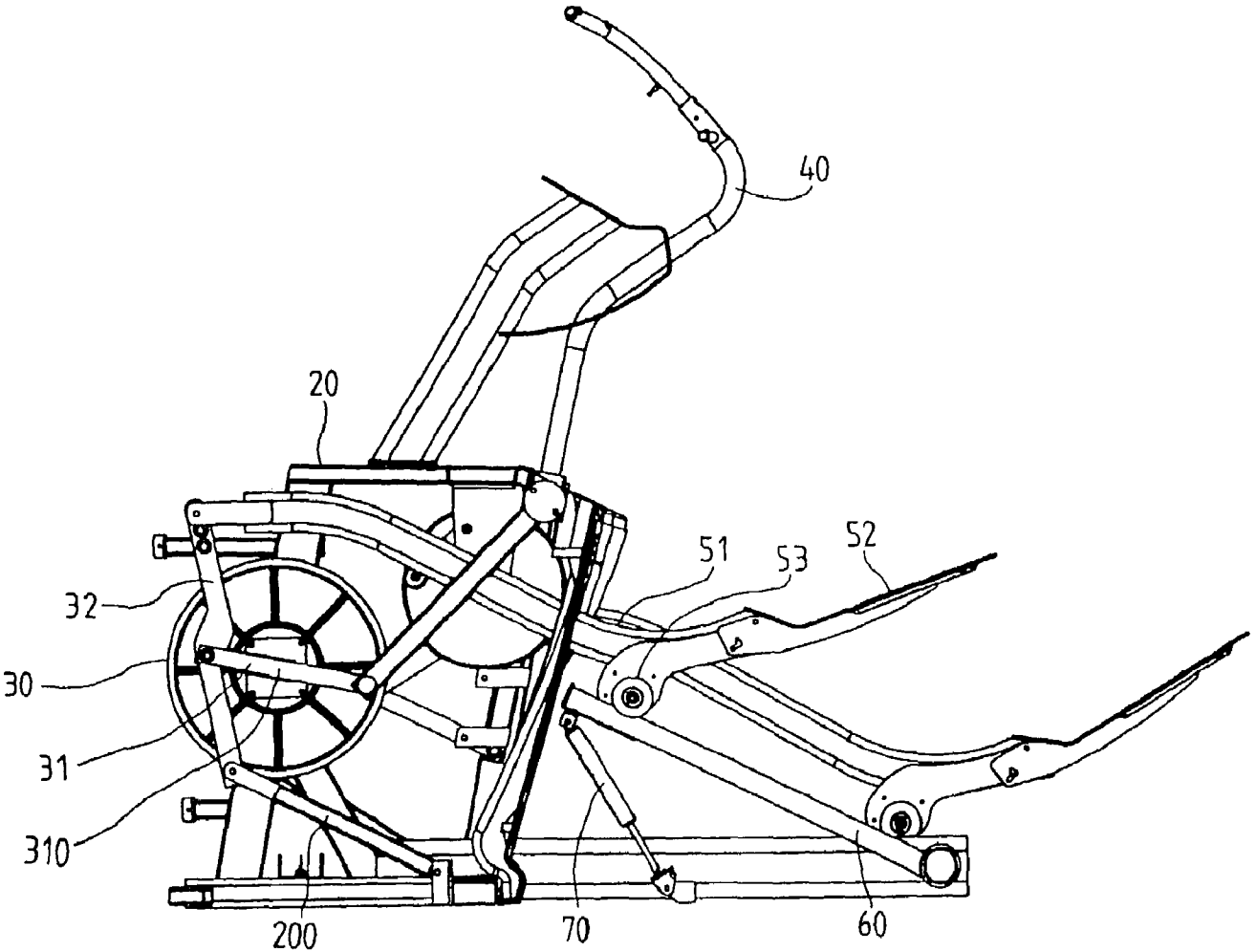
FIG. 5 is shows the elliptical exerciser with the pedal assembly of the present invention.
Figure 6:
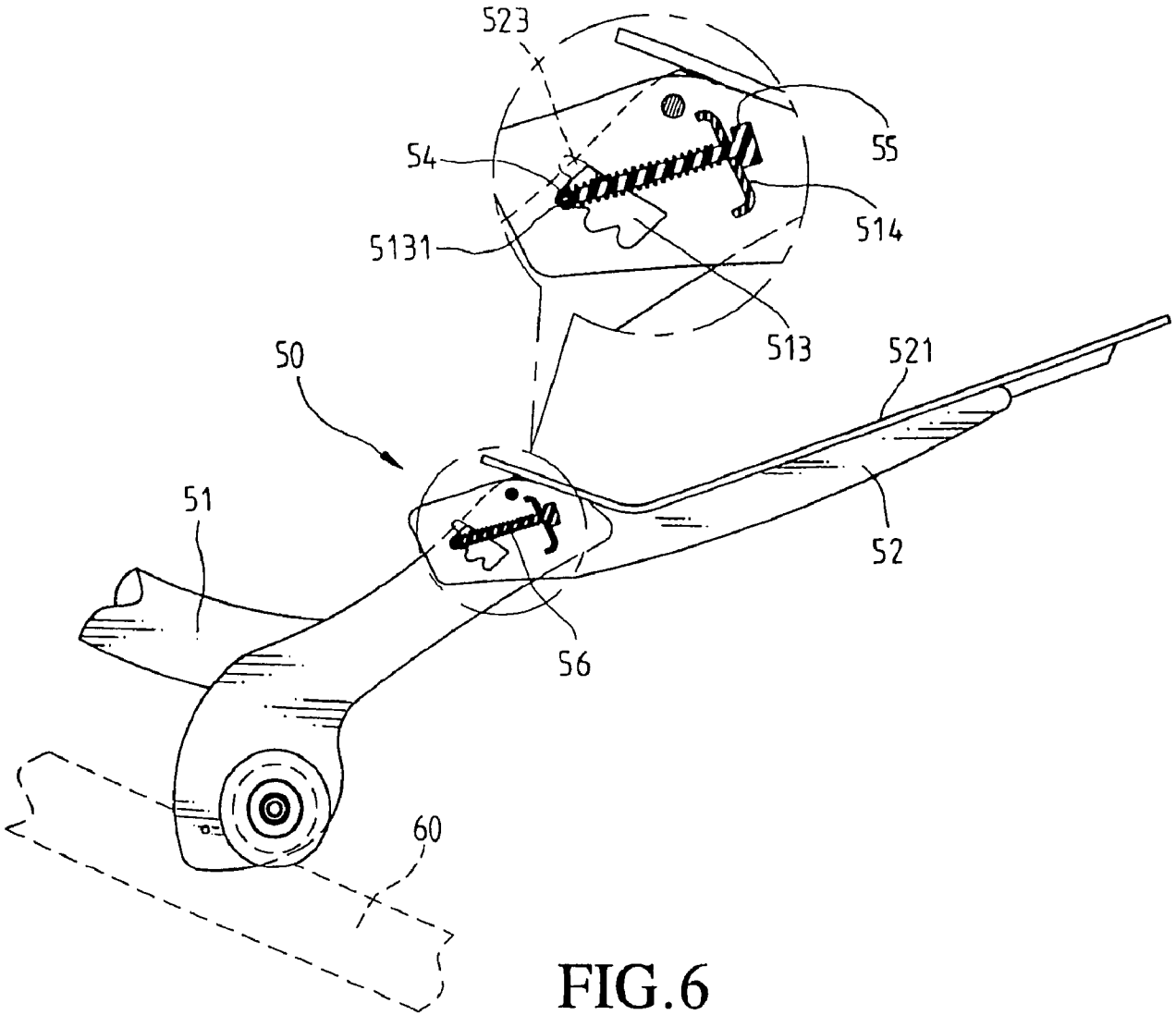
FIG. 6 shows the pin is engaged with the first notch in the hole of the pedal frame when the rails are positioned at the first position as shown in FIG. 5.
Figure 7:
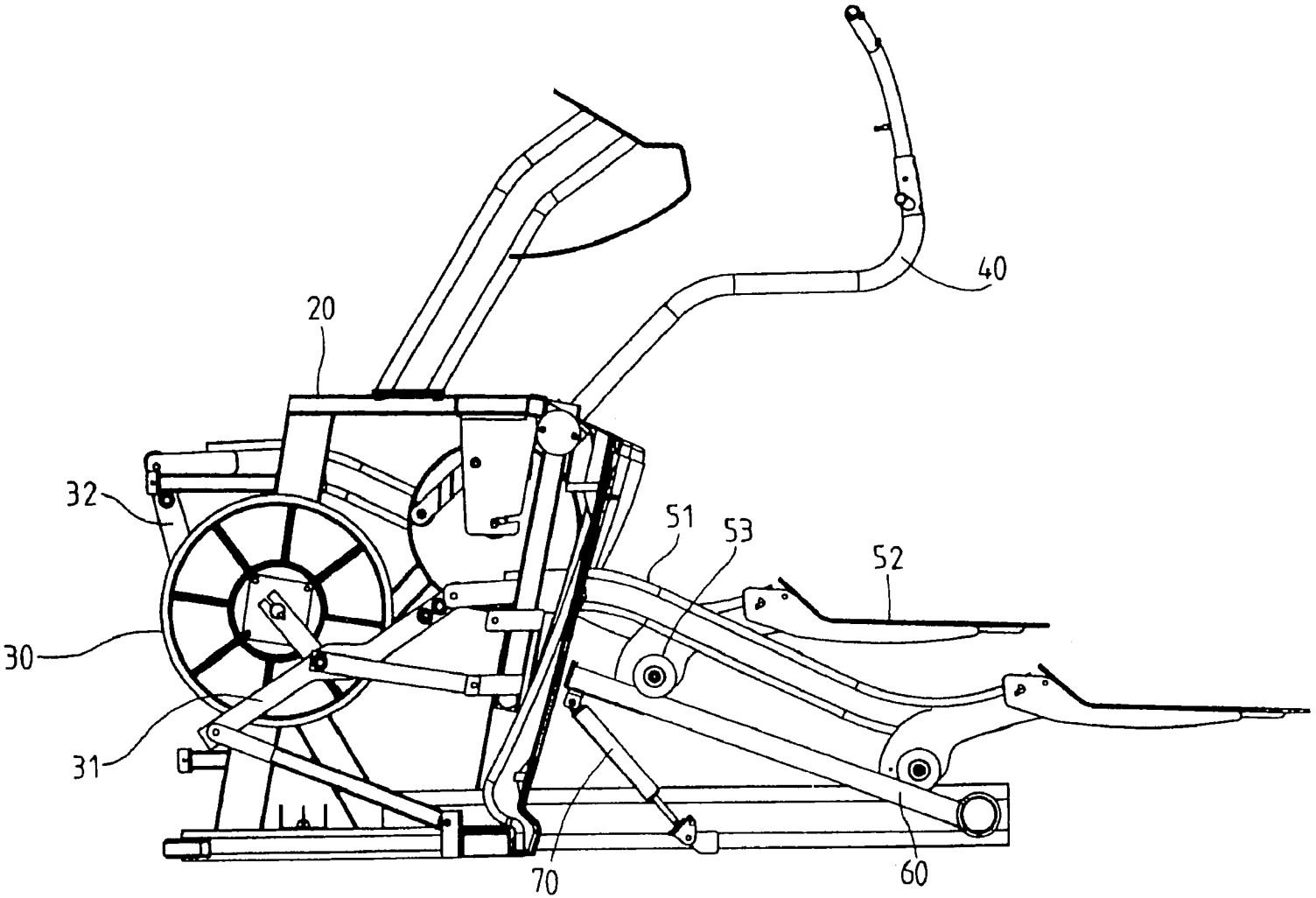
FIG. 7 is shows the elliptical exerciser with the pedal assembly of the present invention.
Figure 8:
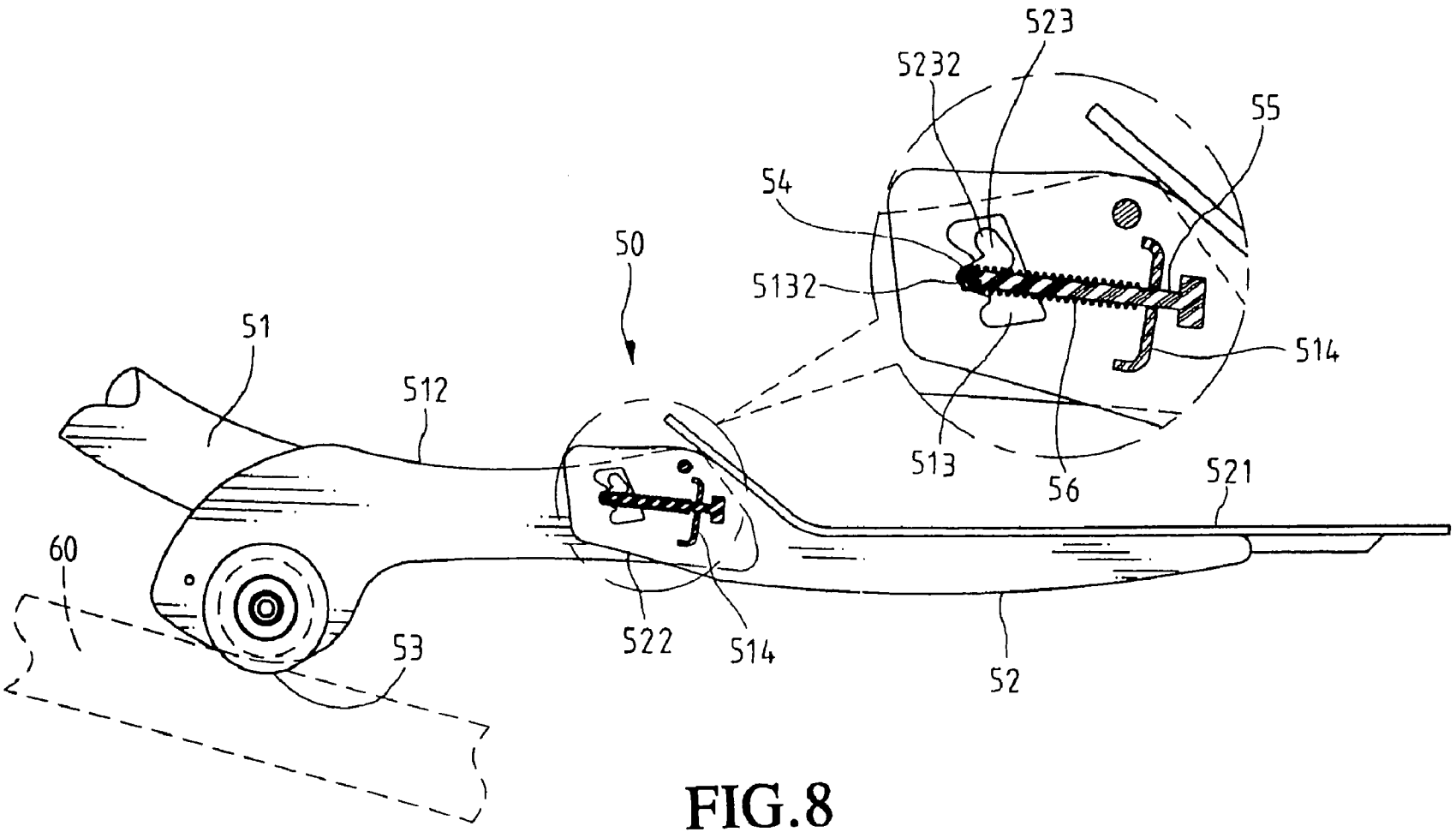
FIG. 8 shows the pin is engaged with the second notch in the hole of the pedal frame when the rails are positioned at the second position as shown in FIG. 6.

The rails 60 is raised to its highest position in FIG. 5 and the pin 54 is located in the set slot 5231 and engaged with the first notch 5131. When the rails 60 are to be lowered to the position as shown in FIGS. 7 and 8, the user simply pushes the pedal 52 counter clockwise and the pin 54 is pulled by a periphery of the set slot 5231 and is disengaged from the first notch 5131. The pin 54 is then slid into the second notch 5132 by the spring 56. By this way, the pedal 52 is pivoted toward horizontal direction and the convenient for the user.

Figure 9:
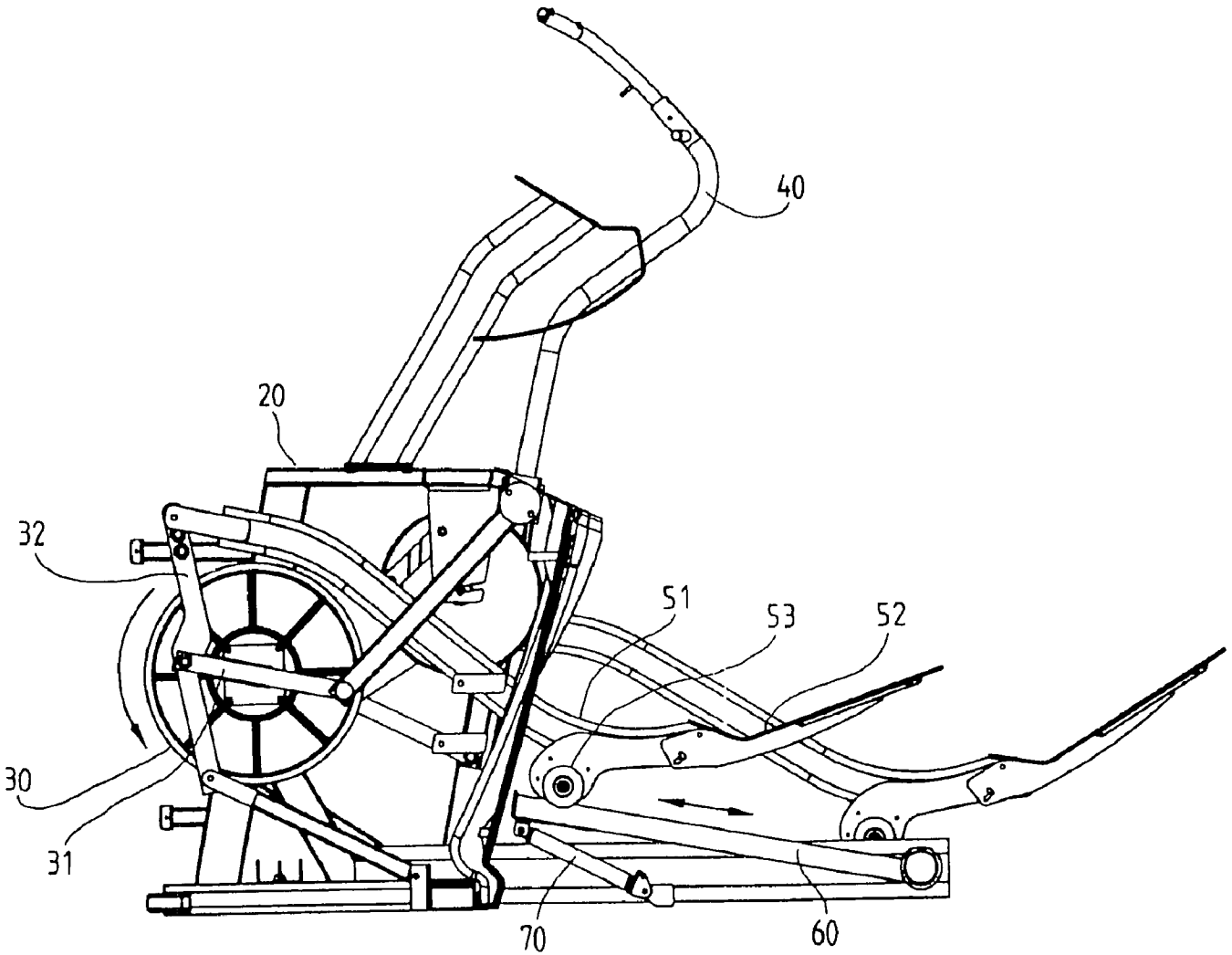
FIG. 9 is shows the elliptical exerciser with the pedal assembly of the present invention.
Figure 10:
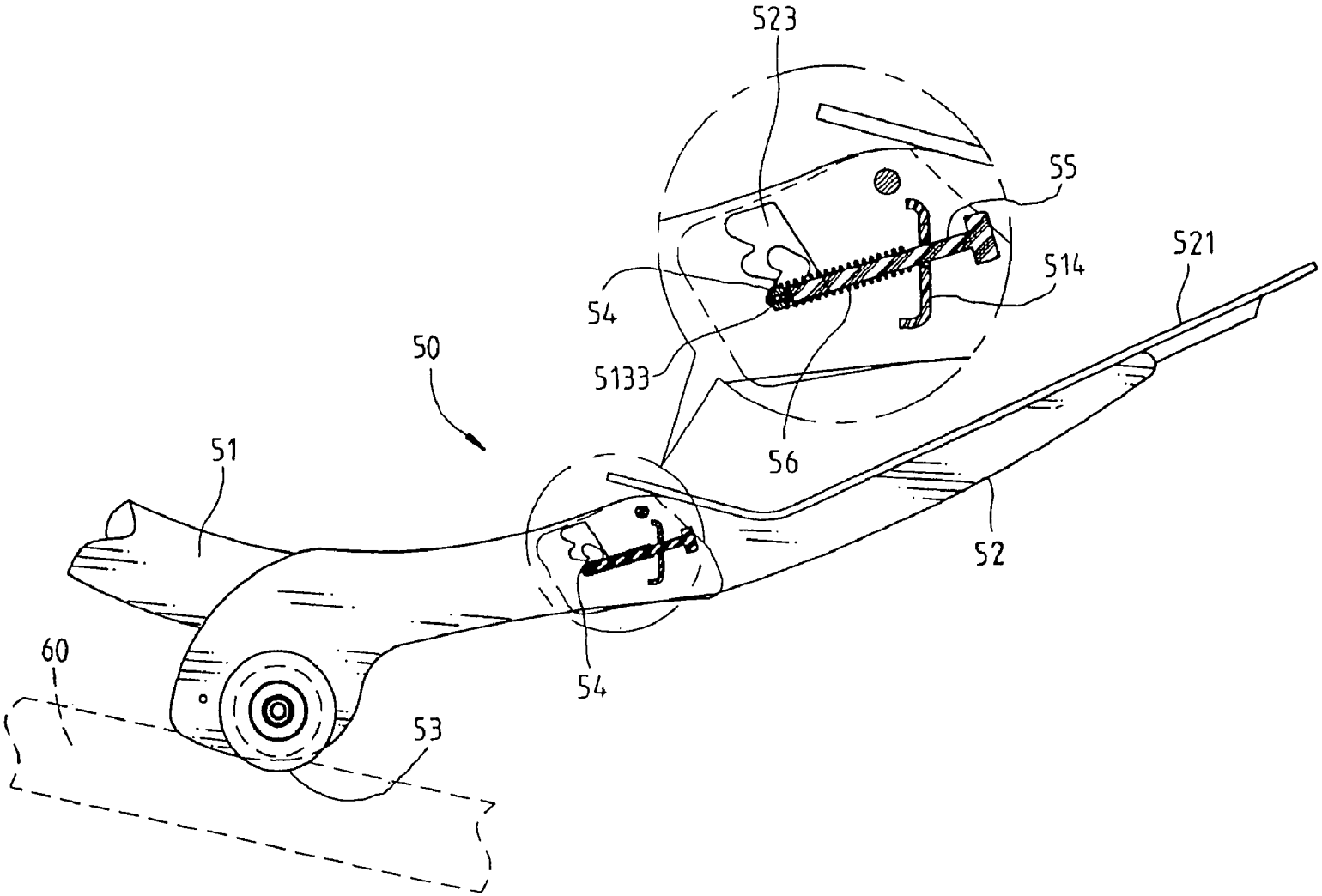
FIG. 10 shows the pin is engaged with the third notch in the hole of the pedal frame when the rails are positioned at the third position as shown in FIG. 9.

If the user wants to further lower the rails 60 as shown in FIGS. 9 and 10, the user pivots the pedals 52 counter clockwise and to remove the pin 54 from the second notch 5132 to the third notch 5133.

Figure 11:
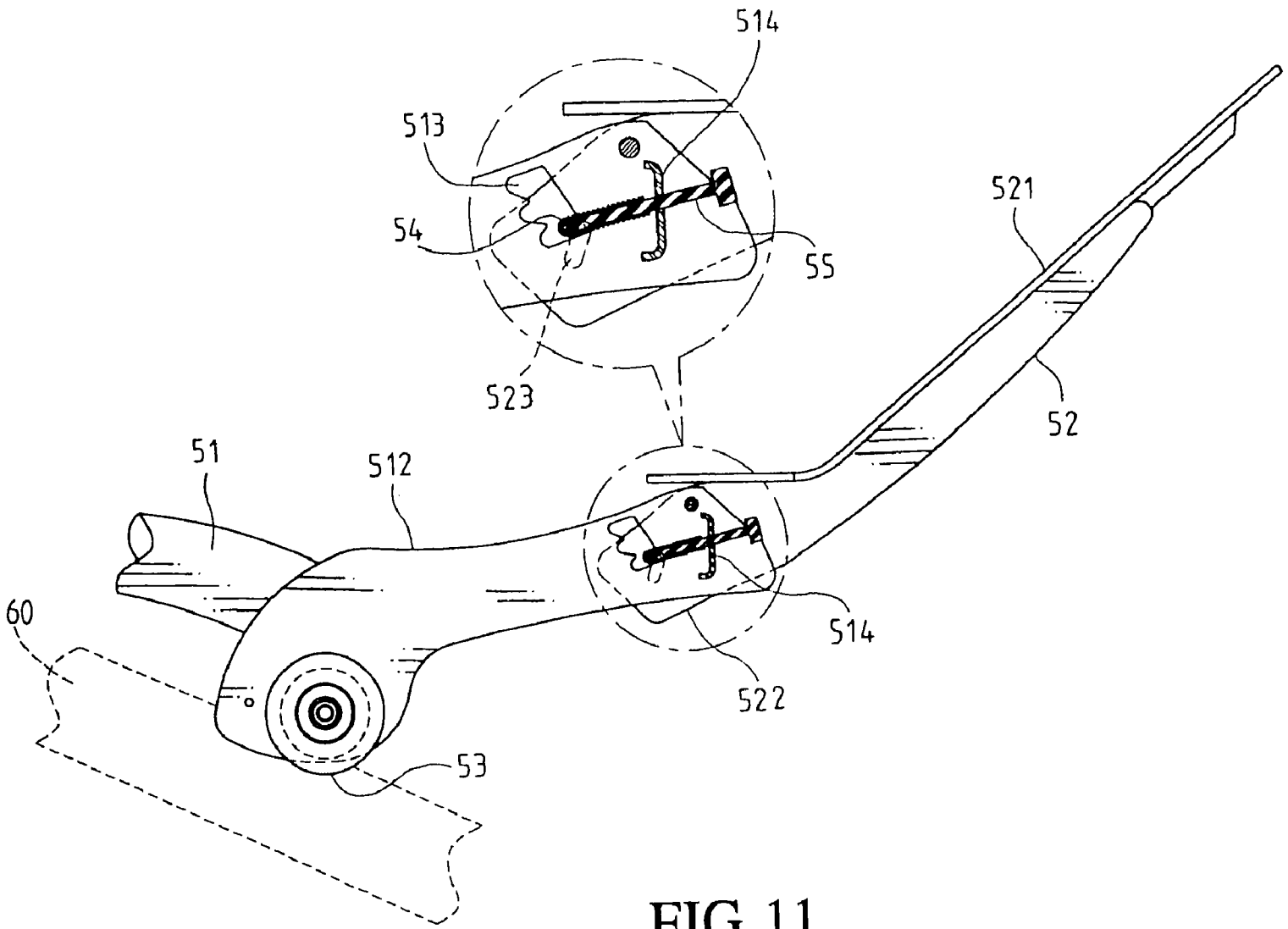
FIG. 11 shows the pin is disengaged from the notches and located in the reset slot.

FIG. 11 shows that when the user wants to remove the pin 54 from the third notch 5133 to another notch 5131 or 5132, the pedal 52 is pivoted counter clockwise to remove the pin 54 from the third notch 5133, the pin 54 is then slid into the reset slot 5232. The pedal 52 is then pivoted clockwise to let the pin 54 enter to one of the three notches 5131, 5132, 5133 This assembly is commonly known as a standard pawl and ratchet system.

The angle adjustable pedals allow the user to comfortably step on the pedals with proper angle according to the adjustment of the rails.

While we have shown and described the embodiment in accordance with the present invention, it should be clear to those skilled in the art that further embodiments may be made without departing from the scope of the present invention.

What is claimed is:

1. A stationary exercise device comprising: (a) a frame, (b) a left foot supporting link and a right foot supporting link each operably supported on the frame for movement of a connection point on each foot supporting link through a generally elliptical path, (c) left and right foot pads pivotably connected to the respective foot supporting link at the respective connection point for pivoting between at least two different angles relative to the respective foot supporting link, and (d) left and right pawl and ratchet systems in operable communication with each respective combination of foot supporting link and foot pad for controlling pivoting of each foot pad about the respective connection point.

2. The stationary exercise device of claim 1 wherein the left and right foot pads are pivotably connected to the respective foot supporting link at the respective connection point for pivoting between at least three different angles.

3. An exercise apparatus, comprising:

(a) a frame designed to occupy a fixed position relative to a floor surface, (b) a left guide and a right guide, wherein each guide is mounted on a respective side of the frame, (c) a left crank and a right crank, wherein each crank is mounted on a respective side of the frame and rotatable relative thereto about a common crank axis, (d) a left rocker link and a right rocker link, wherein each rocker link is mounted on a respective side of the frame and pivotal relative thereto about a common rocker axis, (e) a left connector link and a right connector link each having a first end portion, a second end portion and an intermediate portion, wherein (i) travel of the intermediate portion of each connector link is constrained for movement along a defined closed loop path by at least a respective crank, and (ii) travel of the first end portion of each connector link is constrained for movement along a reciprocating path by at least a respective rocker link, (f) a left foot supporting link and a right foot supporting link each having a forward end portion, an intermediate portion, and a rearward end portion, wherein (i) each intermediate portion is rollable along a respective guide, (ii) travel of each forward end portion is constrained for movement along a closed loop path by at least the second end portion of the respective connector link, and (iii) a connection point on each foot supporting link is positioned within the rearward end portion of the foot supporting link and travels through a generally elliptical path, (g) a left foot pad and a right foot pad, each pivotably connected to the respective foot supporting link at the respective connection point as between at least two different angles, and (h) left and right pawl and ratchet systems in operable communication with each respective combination of foot supporting link and foot pad for controlling pivoting of each foot pad about the respective connection point.

4. The stationary exercise device of claim 3 wherein the left and right foot pads are pivotably connected to the respective foot supporting link at the respective connection point for pivoting between at least three different angles.

5. A method of facilitating elliptical motion exercise, comprising the steps of:

(a) providing a frame adapted to rest upon a floor surface, (b) mounting a left foot supporting link and a right foot supporting link on the frame for constrained travel of a connection point on each foot supporting link through a generally elliptical path, (c) pivotably connecting a left foot pad to the left foot support link at the connection point on the left foot support link for pivoting of the left foot pad relative to the left foot supporting link as between at least two different angles, (d) pivotably connecting a right foot pad to the right foot support link at the connection point on the right foot support link for pivoting of the right foot pad relative to the right foot supporting link as between at least two different angles, (e) controlling pivoting of the left foot pad relative to the left foot support link about the connection point with a left pawl and ratchet system, and (f) controlling pivoting of the right foot pad relative to the right foot support link about the connection point with a right pawl and ratchet system.

6. The method of claim 5 wherein the connecting steps comprise pivotably connecting each of the left and right foot pads to the respective foot supporting link at the respective connection point as between at least three different angles.

7. A method of facilitating elliptical motion exercise, comprising the steps of:

(a) providing a frame adapted to rest upon a floor surface, (b) mounting left and right linkage assemblies on the frame, wherein each of the linkage assemblies includes at least (a) a rotating member rotatably mounted on a first frame portion, (b) a guide mounted on a second frame portion, and (c) a connector link movably interconnected between the rotating member and the guide in a manner that links rotation of the rotating member to movement of a connection point on the linkage assembly through a generally elliptical path, (c) connecting a left foot supporting link to a respective connection point proximate a first end of the left foot supporting link, (d) connecting a right foot supporting link to a respective connection point proximate a first end of the right foot supporting link, (e) pivotably connecting a left foot pad to the left foot support link proximate a second end of the left foot support link for pivoting of the left foot pad relative to the left foot supporting link as between at least two different angles, (f) pivotably connecting a right foot pad to the right foot support link proximate a second end of the right foot support link for pivoting of the right foot pad relative to the right foot supporting link as between at least two different angles, (g) controlling pivoting of the left foot pad relative to the left foot support link about the connection point with a left pawl and ratchet system, (h) controlling pivoting of the right foot pad relative to the right foot support link about the connection point with a right pawl and ratchet system, (i) constraining an intermediate portion of the left foot support link to move through a reciprocal path relative to the frame, and (j) constraining an intermediate portion of the right foot support link to move through a reciprocal path relative to the frame.

8. The method of claim 7 wherein steps (e) and (f) comprise pivotably connecting each of the left and right foot pads to the respective foot supporting link at the respective connection point as between at least three different angles.

* * * * *